US008328588B2

(12) United States Patent
Ramm et al.

(10) Patent No.: US 8,328,588 B2
(45) Date of Patent: Dec. 11, 2012

(54) SCREWLESS CONNECTION TERMINAL

(75) Inventors: Andreas Ramm, Kirchhundem (DE); Walter Schepe, Kirchhundem (DE)

(73) Assignee: Bals Elektrotechnik GmbH & Co. KG (DE)

( * ) Notice: Subject to any disclaimer, the term of this patent is extended or adjusted under 35 U.S.C. 154(b) by 0 days.

(21) Appl. No.: 13/270,483

(22) Filed: Oct. 11, 2011

(65) Prior Publication Data

US 2012/0088415 A1 Apr. 12, 2012

(30) Foreign Application Priority Data

Oct. 12, 2010 (EP) ..... 10013544

(51) Int. Cl.
*H01R 11/20* (2006.01)

(52) U.S. Cl. ..... 439/828

(58) Field of Classification Search ..... 439/409, 439/391, 410, 432–436, 387, 393, 828
See application file for complete search history.

(56) References Cited

U.S. PATENT DOCUMENTS

| | | | | |
|---|---|---|---|---|
| 4,768,981 | A * | 9/1988 | Hohorst | 439/835 |
| 7,083,463 | B2 * | 8/2006 | Steinkemper et al. | 439/441 |
| 7,115,001 | B1 * | 10/2006 | Brockman et al. | 439/828 |
| 7,238,043 | B2 * | 7/2007 | Reibke et al. | 439/441 |
| 7,249,963 | B2 * | 7/2007 | Ramm et al. | 439/437 |
| 7,648,403 | B2 * | 1/2010 | Rueggen et al. | 439/828 |
| 7,704,106 | B2 * | 4/2010 | Koellmann | 439/834 |
| 7,896,686 | B2 * | 3/2011 | Hoppe | 439/441 |
| 2006/0063420 | A1 * | 3/2006 | Reibke et al. | 439/441 |

FOREIGN PATENT DOCUMENTS

| | | | |
|---|---|---|---|
| DE | 3911459 | A1 | 10/1990 |
| DE | 19831851 | C1 | 2/2000 |
| DE | 102004045025 | B3 | 2/2006 |
| EP | 1152271 | A2 | 11/2001 |
| FR | 2936659 | A1 | 4/2010 |

* cited by examiner

*Primary Examiner* — Neil Abrams
*Assistant Examiner* — Phuongchi Nguyen
(74) *Attorney, Agent, or Firm* — Kaplan Breyer Schwarz & Ottesen, LLP

(57) ABSTRACT

A screwless connection terminal with a contact element to which a conductor is to be electrically connected, the contact element comprising a connecting section and a contact surface, with a clamp spring by means of which the conductor is to be clamped to the contact surface of the contact element, wherein the clamp spring has a clamping leg, an abutting leg and a tensioning leg, wherein a clamp opening is formed in the clamping leg, through which clamp opening, the conductor is to be led, wherein the abutting leg of the clamp spring abuts on the contact element, and the tensioning leg of the clamp spring connects the abutting leg to the clamping leg, wherein the clamping leg further comprises a conductor clamp extension with a clamping face which is aligned substantially parallel to the contact surface of the contact element.

31 Claims, 9 Drawing Sheets

SCREWLESS CONNECTION TERMINAL

CROSS-REFERENCE TO RELATED APPLICATIONS

European patent application EP 10013544.1, filed Oct. 12, 2010, is incorporated herein by reference.

FIELD OF THE INVENTION

The invention relates to a screwless connection terminal for connecting an electrical conductor, in particular for an electrical plug connector device.

BACKGROUND OF THE INVENTION

As is well known, generic screwless connection terminals which usually have clamp springs, which often are designated as cage clamp springs, have the advantage that a conductor to be electrically connected can be mounted without screwing means. Through the principle of clamping the core ends of the conductor, which basically can be a single- or multi-core electric cable with a stranded wire line, a solid wire or a conductor inserted in a core end ferrule, to a contact element, an automatic adaptation to the respective cross-section takes place. This makes it possible that one and the same connection terminal can be used for differently dimensioned flexible lines and cables. Said connection terminals are used, among other things, in electrical plug connector systems which are designed for three-phase current and/or alternating current and consist of a plug part and a coupling part or a wall socket such as, for example, connector plugs, flanged connector plugs, wall-mounted plugs, surface-mounted plugs and electrical outlets, the requirements for which are further described in the standards IEC 60309-1 and EN 60309-1, -2.

A plug connector device known from EP 1 072 067 B1 has a screwless conductor terminal accommodated in a plug connector or in a coupling. The substantially tubular connector or coupling housing made of insulating plastic comprises an inner cylindrical contact element carrier which holds the contact elements in position. Said contact element carrier of the connector housing is configured for receiving contact pins and the contact element carrier of the coupling is configured for receiving socket contacts. When mounting the conductor to the screwless connection terminal, the connector end of the cable is led through a cover which is made of insulating plastic and is connected to the plug connector or coupling housing and has a strain relief device for the cable. The core ends to be connected which are exposed beforehand are subsequently fixedly clamped to the contact elements in the contact element carrier by means of a clamp spring. Said clamp spring has a clamp opening which needs to be brought in a pretensioned release position and into which the conductor to be connected is inserted with the core end that has been stripped beforehand. Once the clamp opening of the clamp spring is subsequently closed, the core end is pulled by means of the cross-sectional area of the clamping leg of the clamp spring against the contact surface of the contact element and subsequently clamped in place whereby an electrical contact is made.

Further screwless conductor terminals using structurally identical clamp springs for clamping electrical conductors to contact elements are known. EP 1 555 724 A1 discloses e.g. a single-pole to multi-pole conductive bus bar having one or more of screwless conductor terminals, wherein said bus bar has a plurality of said aforementioned clamp springs arranged next to each other for connecting a plurality of conductors.

In case of this type of clamping, the effective clamping surface of such screwless connection terminals is limited to the profile cross-section of the clamp spring and is only a few square millimeters. As a result of this, in case of screwless connection terminals according to the prior art, there are usually high electrical contact resistances which result in excessive heat generation. These disadvantages are increasingly experienced in particular in such cases in which high electric currents, e.g. 32 A and higher, are to be transmitted. Also, a comparatively high electrical contact resistance exists at further possible contact area sections against which the conductor abuts, but does not experience any directly acting clamping force applied by the cross-sectional area of the clamping leg of a connection terminal or a clamp spring.

The electric current generally flowing through the contact resistances of a screwless connection terminal according to the prior art thus generates a significant heat quantity which has to be dissipated via the contact element. However, if high electrical currents flow through such a conductor terminal, the result is, besides an excessive heat generation, a high electrical loss and a high risk with respect to melting or fire hazard. Thus, it can principally be concluded that the field of use with respect to ampacity of screwless connection terminals, the electrical contact of which is established by means of the cross-sectional area of the clamping leg of a clamp spring, is limited.

SUMMARY OF THE INVENTION

It is therefore an object of the invention to provide an improved screwless connection terminal using clamping spring technique which can be produced in a simple and cost-effective manner and ensures a safe mechanical and electrical connection, in particular also during high current loads while simultaneously reducing the generation of heat.

Essential advantages of the invention and the individual embodiments or developments thereof are thus based on the fact that a fast, safe and controlled electrical and also mechanical connection is made possible with a conductor and larger electrical contact areas with low electrical losses are created, whereby the field of use of a screwless connection terminal according to the invention is extended with respect to its rated current and the ampacity. Furthermore, the screwless connection terminal according to the invention allows for a good heat transfer due to a lower contact resistance between the conductor to be connected and the electrical contact element in or on an electrical plug-in device or connecting device and reduces the danger of overheating or destruction of such a device. Furthermore, with respect to the mechanical fastening of a conductor to the contact element of an electrical device, the invention provides for an improvement of the mechanical tensile strength.

In particular, it is provided that the screwless connection terminal according to the invention has at least one contact element and at least one clamp spring mounted thereon. Both components can be arranged as a pair in a plug-in device or connecting device such as, e.g., in a plug-connector, a coupling, a wall socket or can optionally be part of a conductor bus bar. Furthermore, the screwless connection terminal according to the invention can be used in housings made of any housing materials, in particular metal housings, and in electrical apparatuses which should or have to meet the requirements described in the standards IEC 60309-1, -2 or EN 60309-1, -2.

The contact element of the screwless connection terminal has a connecting section with an electrical contact surface which is provided for making contact, that is, for electrically connecting to the conductor to be connected. If the contact element is arranged in a plug-connector, a coupling or a wall socket, said contact element, in case of a plug-connector, is advantageously configured in a pin-like manner as a contact pin or, in case of a coupling/wall socket, is configured in a socket-like manner as a socket contact. Hereinafter, only the term contact element is used, wherein said term designates, if not otherwise stated, a contact pin, a socket contact or also a contact rail or the like.

The clamp spring of the screwless connection terminal serves for detachably fixing the conductor to the contact element by means of clamp fastening to the contact surface of the latter. Said clamp spring is preferably configured as a cage clamp spring and comprises an abutting leg, a clamping leg and a tensioning leg which connects the abutting leg to the clamping leg. The abutting leg serves for fixing the clamp spring on the contact part while the clamping leg effects the necessary spring preload force. The clamping leg is provided with a clamp opening which allows for a crossing with the abutting leg and provides a passage for the core ends of the conductor for clamp fastening to the contact element. Preferably, the clamp spring is pretensioned when mounted on the contact element.

In contrast to conventional embodiments of clamp springs for screwless connection terminals according to the prior art, the clamp spring according to the invention has another element on the clamping leg of the clamp spring, which element is designated as conductor clamp extension and in a practical embodiment, is advantageously configured as sheet metal extension or sheet metal lug. Said conductor clamp extension has a defined clamping face and significantly improves the function of the cross-sectional area of a clamping leg in the clamp opening of conventional clamp springs, wherein said clamping face usually serves for clamping the conductor cores of the conductor to the contact surface of the contact element. In the clamp spring's state mounted on the contact element, said clamping face extends substantially parallel to the contact surface of the contact element and serves for pressing down and clamping the conductor cores of the conductor onto the contact surface of the contact element after the conductor cores have been inserted into the clamp opening of the clamp spring.

In case of a conductor comprising a plurality of conductor cores such as, e.g., a stranded wire line, this conductor clamp extension effects in an advantageous manner a flattening of the conductor core profile. For this purpose, the clamp spring is preferably provided with the necessary adequate spring preload force. By enlarging the electrical contact surface, on the one hand, a reduction of the ohmic resistance of the contact resistance is achieved, wherein the electric current is partially transmitted via the conductor clamp extension onto the spring clamp and subsequently via the abutting leg of the latter to the contact element. Furthermore, the heat transfer surface of the conductor as well as the tensile strength is increased due to the increase of the friction surface.

In case of clamping a rigid wire conductor to the connection terminal, the conductor clamp extension possibly effects only a minor flattening or no flattening of the conductor core profile of the conductor. Nevertheless, compared to conventional embodiments of screwless connection terminals in case of which clamping of the conductor takes place only via a cross-sectional area of the clamping leg of the clamp spring, the contact resistance and the heat transfer resistance to the contact element is also reduced due to the larger clamping surface abutting with pressure on the conductor and due to the resulting greater effectiveness of the clamping forces acting on a larger contact surface on the contact element.

The heat losses which, during the operation or also when connecting electric plug connectors under a current load, are produced due to the electric current flowing through the contact resistance between the conductor and the contact element are advantageously dissipated via the contact element. For this purpose, the contact element of a preferred embodiment is equipped with at least one cooling surface element for improving the heat transfer to the environment. For the purpose of improving heat dissipation, the contact element of a particularly advantageous embodiment is provided with a single-part or multi-part groove for increasing the surface of the contact element, for example an annular groove and/or a longitudinal groove which is preferably created in the contact element by turning or milling.

Furthermore, the conductor clamp extension's clamping face abutting against the conductor cores provides for additional heat dissipation to the contact element via the clamp spring. For this purpose, the abutting leg of the clamp spring can be connected to the contact element in a particularly advantageous manner via a recess in the contact element. Advantageously, the recess has a profile shape here which is complementary to the one of the abutting leg of the clamp spring.

For further improving the heat transfer, the electric contact resistance and/or the heat exchange between two contact elements to be connected of plug connector devices to be paired, e.g. a plug connector with contact pins and a coupling with socket contacts, it is proposed in a particularly advantageous embodiment that a socket-like contact element is provided with a clamp spring ring. These clamp spring rings serve for increasing the clamping connection force, i.e., when the pin-like contact elements, thus the contact pins, of a plug connector are plugged into the socket-like contact elements of a coupling. Preferably, this clamp spring ring is recessed within a groove or annular groove in the surface of the socket contact and thus is fixed with respect to axial displacement. Instead of a clamp spring ring, other commercially available springs or spring elements suitable for increasing the clamping connection force of plug connector devices can also be used.

In a preferred further development of the invention it is provided that the clamping face of the conductor clamp extension, at least in a partial area, has a clamping section that has a clamping face profile which, relative to the remaining clamping face of the conductor clamp extension, is curved or chamfered, wherein preferably the end section of the conductor clamp extension is formed in such a manner. Hereby, the electrical contact and the tensile strength of the connection terminal are further improved. However, it is also possible to provide the longitudinal profile of the conductor clamp extension in the axial direction of the conductor to be connected with a curvature, or to configure said profile in an angled manner.

An angled or chamfered profile, preferably in the connection direction of the conductor, the conductor clamp extension or a clamping section, allows that the latter presses transverse to the surface and at an angle into the surface of the conductor cores of the conductor even if the clamp opening of the clamp spring is closed after inserting the conductor, wherein the electrical contact resistance and the heat transfer resistance are further reduced. If an axial tensile force is exerted on the conductor or the cable, this has the effect that the end section of the conductor extension is further pressed into the conductor cores, whereby the deformation surface of the clamped conductor cores and the tensile resistance are further increased.

Below, only the term conductor clamp extension is used in a simplifying manner, wherein, provided that no other explanation is given in this regard, an angled or curved clamping section attached to the conductor clamp extension can also be comprised.

The connecting section of the contact element, the contact surface of the latter and/or the surface of the clamping face of the conductor clamp extension as well as the angled or bent clamping section of the screwless connection terminal preferably has a contact surface which is at least partially profiled. This surface profile can have a surface structure similar to a profile of pliers so that the conductor to be connected abuts with an improved frictional engagement, whereby, on the one hand, the electrical contact resistance and the heat transfer resistance is further reduced by pressing these surface structures into the conductor cores of the conductor and, on the other, a particularly effective mechanical connection with high tensile strengths between the core ends of the conductor and the contact element as well as the conductor clamp extension is achieved.

Optionally, a further reduction of the contact resistance and an improvement of the heat transfer as well as the corrosion resistance of the contact surface can be effected through a surface finish of these contact surfaces, e.g. by means of a metal alloy. In a particularly advantageous manner, said surface finish has a plastic or elastic deformability for increasing the contact surface and adapting the contact surface to the conductor profile when the conductor is clamped between the clamping face of the contact element and the conductor clamp extension of the clamp spring.

Furthermore, viewed in the axial direction of the conductor to be connected, the conductor clamp extension can have a particularly advantageously shaped cross-sectional profile in that said profile corresponds substantially to the cross-sectional profile of a conductor. Preferably, the cross-sectional profile of the conductor clamp extension can be semicircularly shaped or has a longitudinal notch or a comparable profile shape which encloses the conductor at least partially so that after inserting the conductor into the clamp opening of the clamp spring, the conductor cores of the conductor rest on the contact surface of the contact element and, upon closing the clamp opening, are laterally fixed by the conductor clamping element in that the clamping face of the conductor clamping element encloses the conductor cores.

For fixing the clamp spring to the contact element, the contact element preferably has a guiding recess on its connecting section, wherein the conductor clamp extension of the clamp spring can engage axially in said guiding recess. In this guiding recess, the contact surface of the contact element is created, e.g. by milling, wherein the front face of the contact element is at least partially recessed so that the conductor can be inserted axially in the guiding recess and can be placed onto the contact surface. For laterally fixing the clamp spring and the conductor cores of the conductor with respect to rotating, the guiding recess has supporting legs on both axial sides of the contact element.

The clamp spring according to the invention used for connecting the conductor to a contact element is preferably made from am suitable electrically conductive strip material, usually from metal, using a punching and forming method. In order to obtain a clamp spring according to the invention which has the appropriate shape, an additional procedural step is used during the production process of the clamp spring, in which additional step preferably also a punching and forming method is used. The conductor clamp extension functioning as pressing-down and clamping element and/or the clamping section is directly formed from a segment of the clamping leg of the clamp spring in that said segment is bent in such a manner that the surface of said segment of the clamping leg is aligned substantially parallel to the surface of the abutting leg of the clamp and/or, in the state mounted on the contact element, is aligned substantially parallel to the contact surface of the contact element. A conductor clamp extension produced in such a manner thus can be configured in a clamping plate-like manner.

In a preferred method, the conductor clamp extension is produced as part of the punching process of the clamp opening in the clamping leg of the clamp spring necessary for passing through the conductor. Here, a segment of the clamping leg of the clamp spring is cut free by a partial separation, for example by a punching process, wherein one side of said segment remains integrally connected to the clamping leg. Subsequently, in a further bending process, this cut segment is bent out of the clamping leg and is suitably aligned or shaped in such a manner that the surface of said segment of the clamping leg is substantially parallel to the surface of the abutting leg of the clamp spring and thus, in the state mounted on the contact element, is also aligned substantially parallel to the contact surface of the contact element. The window opening advantageously generated at the same time in the clamping leg of the clamp spring through this procedural step fulfils at the same time the function of a clamp opening for passing through a conductor when connecting to the screwless connection terminal. Thus, a conductor clamp extension produced in such a manner can also be formed in a clamping plate-like manner.

In an alternative method, the clamp opening in the clamping leg of the clamp spring is completely punched out. Subsequently, in a second procedural step, the conductor clamp extension is attached to the clamping leg, namely in particular by means of screwing, riveting or joining, wherein joining can also involve a firmly bonding joining process, preferably welding or soldering. The material used for the conductor clamp extension can differ from the material of the clamp spring, wherein preferably, a metal or a material with a high electrical conductivity and a high thermal conductivity is used for producing the conductor clamp extension. The outer geometry and/or the cross-sectional profile of the conductor clamp extension can differ from the one of a clamp spring or the clamping leg thereof and all conceivable cross-sectional profiles and geometrical shapes suitable for the function of the conductor clamp extension are possible.

BRIEF DESCRIPTION OF THE DRAWINGS

The invention is described by means of the drawings. In the figures.

DETAILED DESCRIPTION

Figure 1A:
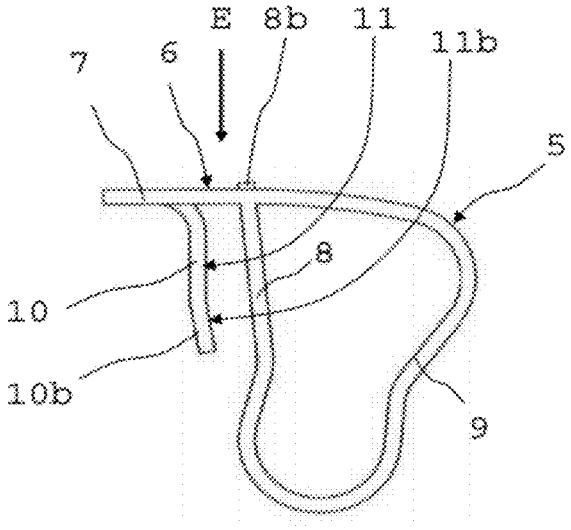
FIGS. 1A to 1D show a clamp spring in a profile view, a side view, a top view and in a perspective view.
Figure 1B:
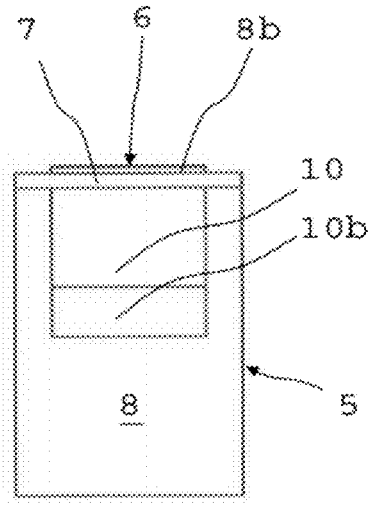
Figure 1C:
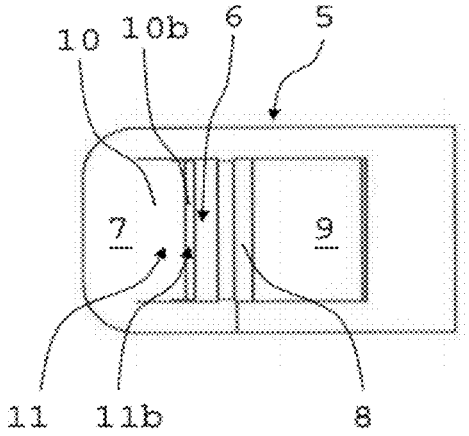
Figure 1D:
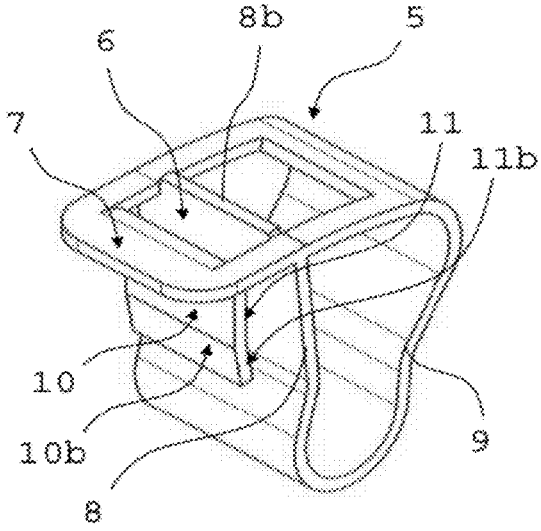

FIGS. 1A to 1D show an embodiment of a bent metal clamp spring 5 of the screwless connection terminal which has a clamping leg 7 and an abutting leg 8. Both spring legs 7, 8 are connected to each other via a tensioning leg 9 (FIG. 1A). In the clamping leg 7 of the clamp spring 5, a clamp opening 6 is recessed (FIG. 1C) which allows for a crossing of the clamping leg 7 and the abutting leg 8 by means of a segment 8*b* of the abutting leg 8 (FIG. 1D). The clamp opening 6 of the clamp spring 5 enables inserting the conductor cores 2*b* of the conductor 2 into the insertion device E. Relative to the clamping leg 7 of the clamp spring 5, the clamping leg 7 further has a conductor clamp extension 10 which is angled at an angle of substantially 90 degrees and which is aligned in the direction of the abutting leg 8 and the clamping face 11 of which is substantially oriented in a clamping plate-like manner parallel to the surface of the conductor clamp extension. Thus, the conductor clamp extension 10 extends from the clamping leg 7 in the insertion direction E of a conductor to be electrically connected. Furthermore, the conductor clamp extension 10 is equipped with an additional clamping section 10*b*, the clamping face 11*b* of which is angled or curved relative to the clamping face 11 of the conductor clamp extension 10 (FIGS. 1A and 1D).

FIGS. 2A to 2E show an embodiment of a contact element 1 of a plug connector device, the contact element being configured as a contact pin, wherein the clamp spring 5 necessary for clamping the conductor is not shown. Similarly, FIGS. 3A to 3E show a contact element 1 of a plug connector device, the contact element being configured as socket contact, wherein here too, a mounted clamp spring 5 is not shown.

Figure 2A:
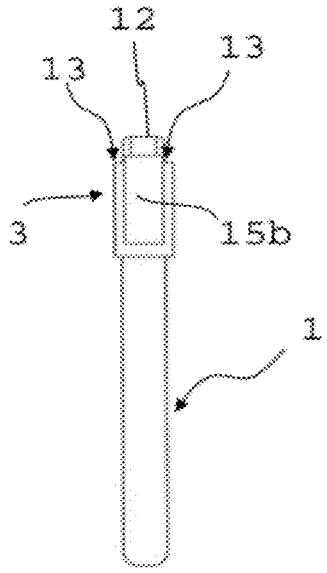
FIGS. 2A to 2E show a contact pin in a bottom view, a side view, a top view, a perspective and a front view.
Figure 2B:
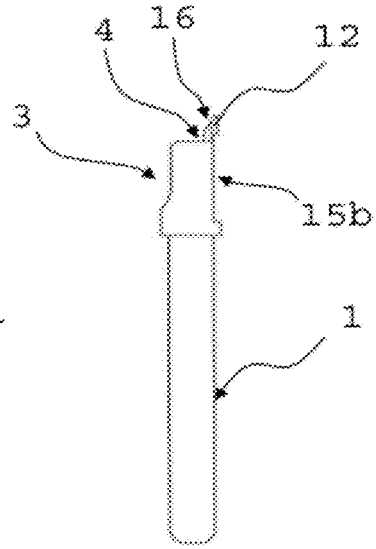
Figure 2C:
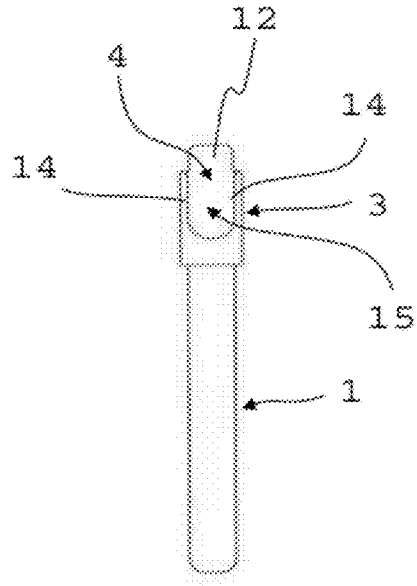
Figure 2D:
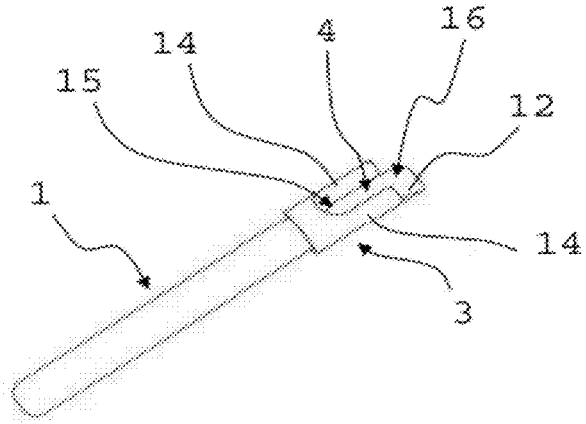
Figure 2E:
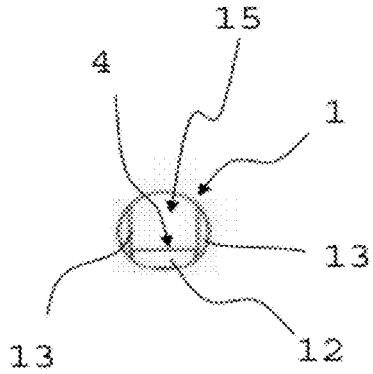
Figure 3A:
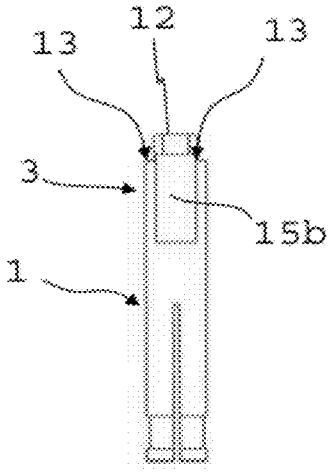
FIGS. 3A to 3E show a socket contact in a bottom view, a side view, a top view, a perspective view and in a front view.
Figure 3B:
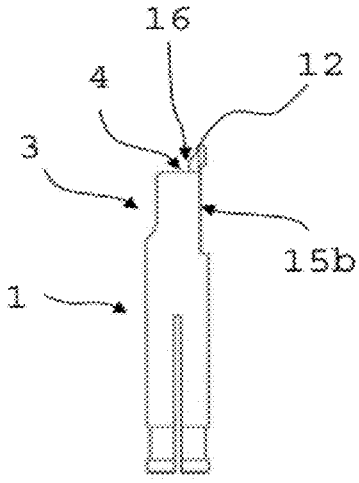
Figure 3C:
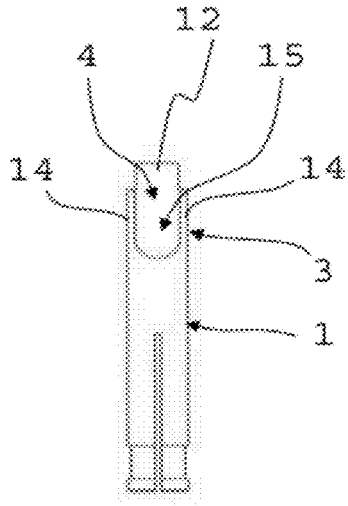
Figure 3D:
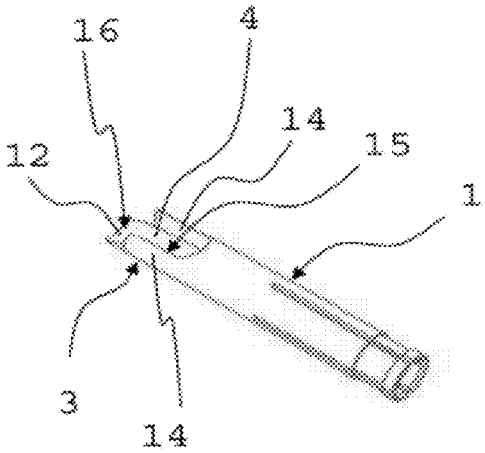
Figure 3E:
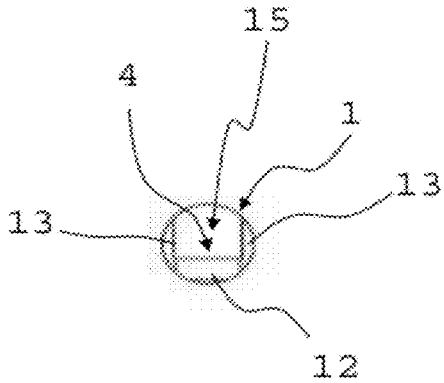

FIGS. 2A to 2D and the FIGS. 3A to 3D show the contact element 1 of the screwless connection terminal with a connecting section 3 and a contact surface 4 arranged thereon onto which the conductor to be connected is placed for establishing an electrical contact. The contact element 1 is equipped with a guide nose 12 which has a chamfer 16 and enlarges the contact surface 4. Said chamfer 16, on the one hand, simplifies mounting of the clamp spring to the contact element and, on the other, fulfils the function of a conductor conduit so that a connected conductor can be safely led away from the contact element, that is, without sharp edges or kinks. Moreover, the contact element 1 is provided with a recess 15*b* in the form of a milled groove which is arranged opposite to the contact surface 4 and serves for receiving the abutting leg (FIGS. 2A, 2B and 3A). A guiding recess 15 which is milled into the connecting section 3 of the contact element 1 serves for engaging with the rectangularly formed conductor clamp extension 10, while lateral supporting legs 14 fix the latter in place, wherein the clamping leg 7 of the clamp spring 5 abuts against the front face 13 of the contact element 1 (FIG. 2E, 3E).

Figure 4A:
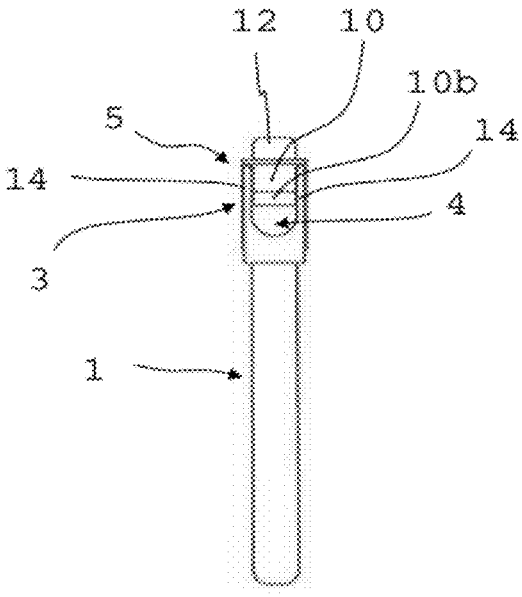
FIGS. 4A to 4D show a contact pin with mounted clamp spring and conductor clamp extension with the clamp opening closed in the top view, the side view, the perspective view and in the front view.
Figure 4B:
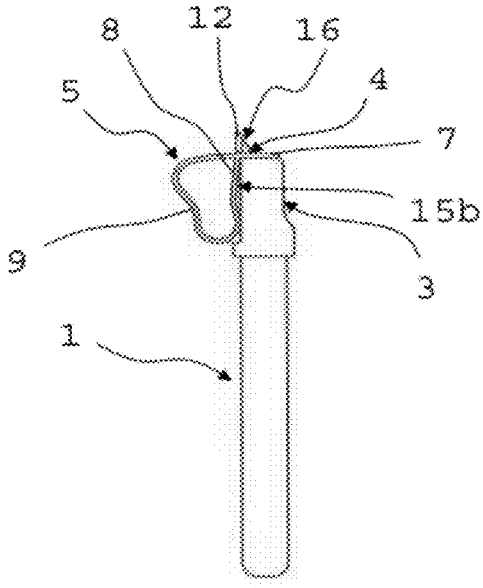
Figure 4C:
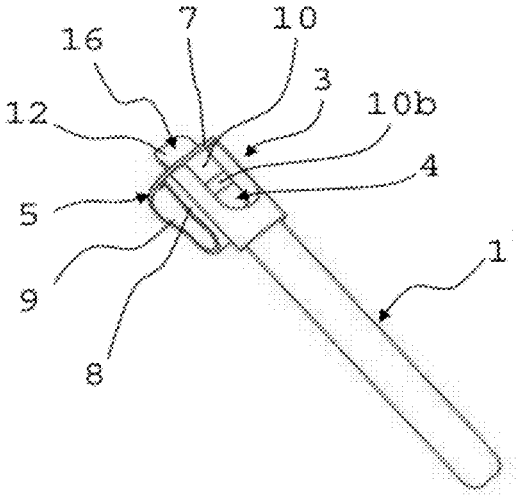
Figure 4D:
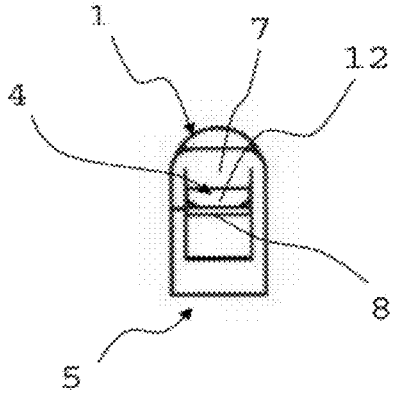
Figure 5A:
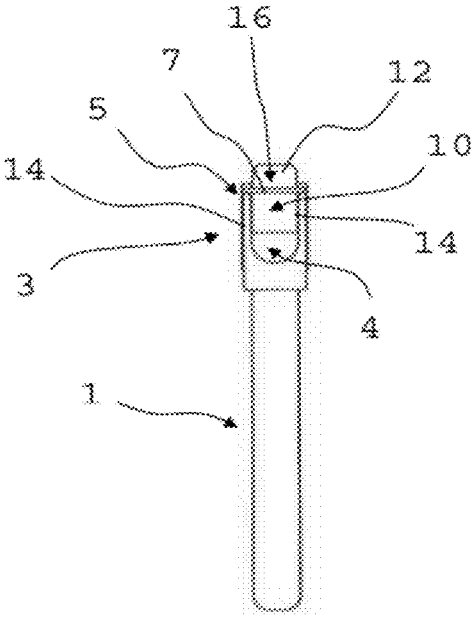
FIGS. 5A to 5D show a contact pin with mounted clamp spring and conductor clamp extension with the clamp opening opened in the top view, the side view, the perspective view and in the front view.
Figure 5B:
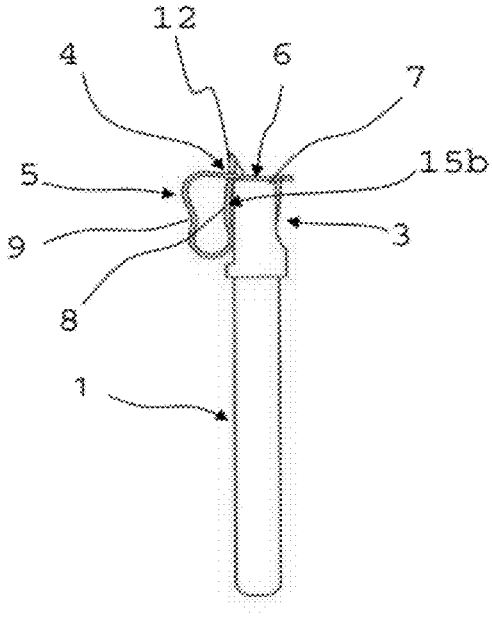
Figure 5C:
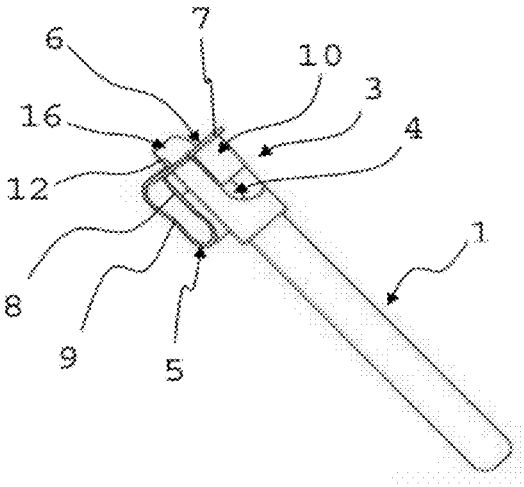
Figure 5D:
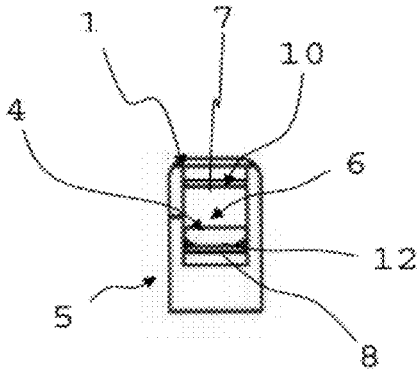
Figure 6A:
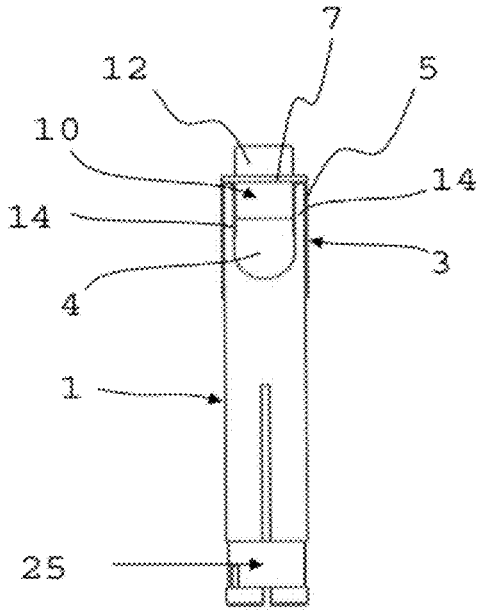
FIGS. 6A to 6D show a socket contact with mounted clamp spring and conductor clamp extension with the clamp opening closed in the top view, the side view, the perspective view and in the front view.
Figure 6B:
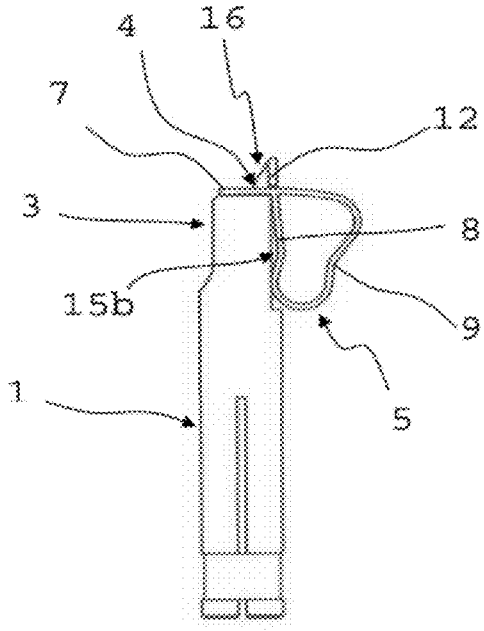
Figure 6C:
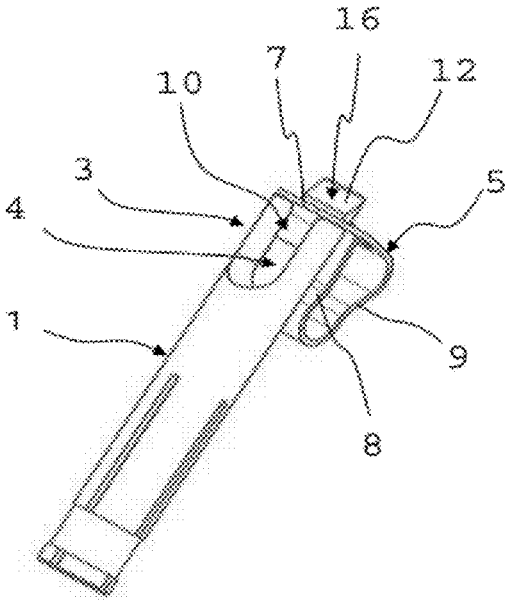
Figure 6D:
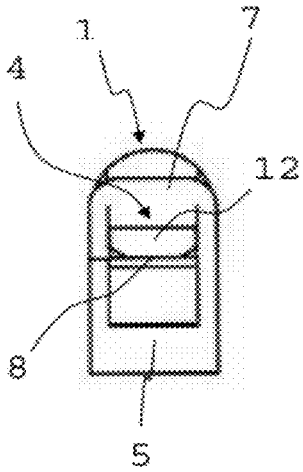

FIGS. 4A to 4D and FIGS. 6A to 6D show a contact element 1 configured as a contact pin and as a socket contact and with a clamp spring attached thereon, wherein the clamp opening 6 is in each case closed and thus is not visible (FIG. 4C, 6C). In addition thereto, FIGS. 5A to 5D and FIGS. 7A to 7D show a contact element 1 configured as a contact pin and as a socket contact and with a clamp spring mounted thereon, wherein the clamp opening 6 is in each case open (FIG. 5C, 6C).

Figure 7A:
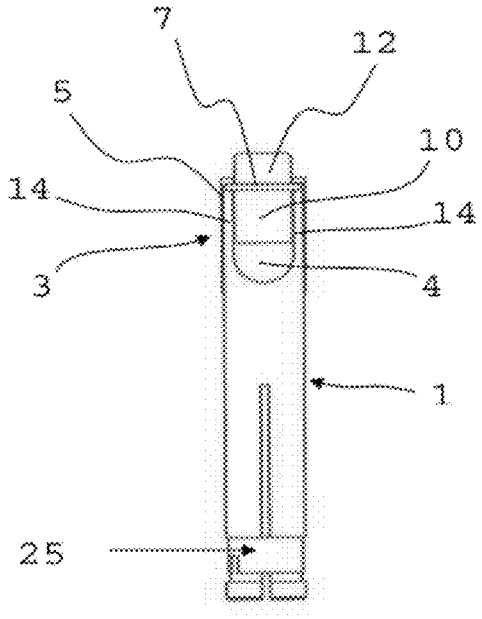
FIGS. 7A to 7D show a socket contact with mounted clamp spring and conductor clamp extension with the clamp opening open in the top view, the side view, the perspective view and in the front view.
Figure 7B:
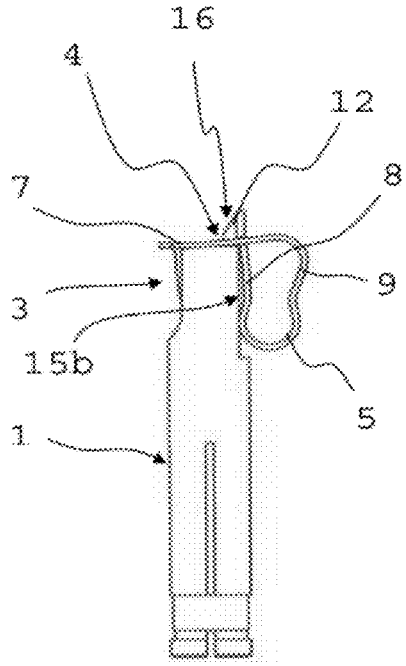
Figure 7C:
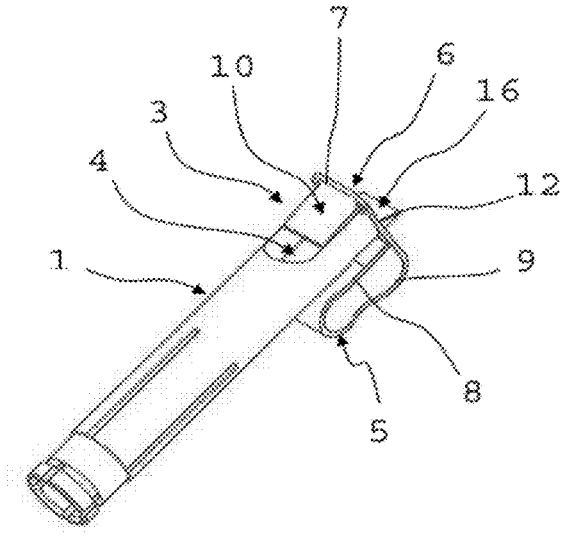
Figure 7D:
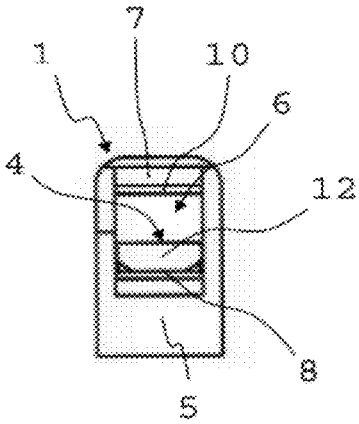

The clamp spring 5 is mounted to the contact element 1 in a pretensioned state. During mounting, the guide nose 12 of the contact element 1 is inserted into the clamp opening 6 of the clamp spring 5 while the clamping leg 7 of the clamp spring 5 abuts on the front side 13 of the contact element 1 (FIG. 4D, 5D, 6D, 7D) and the rectangular conductor clamp extension 10 engages in the guiding recess 15 (FIGS. 4A, 5A, 6A, 7A) and the abutting leg 8 engages in the recess 15*b* (FIGS. 4B, 5B, 6B, 7B), whereby a force-fitting connection and a fixation of the clamp spring 5 on the contact element 1 is achieved. Accordingly, a movement of the clamping leg 7 relative to the front face 13 of the contact element 1 is only possible if the tensioning leg 9 is compressed against the spring preload force, whereby the clamp opening 6 is caused to open for connecting the conductor to the contact pin 1 (FIG. 5C) or the socket contact 1 (FIG. 7C).

Figure 8A:
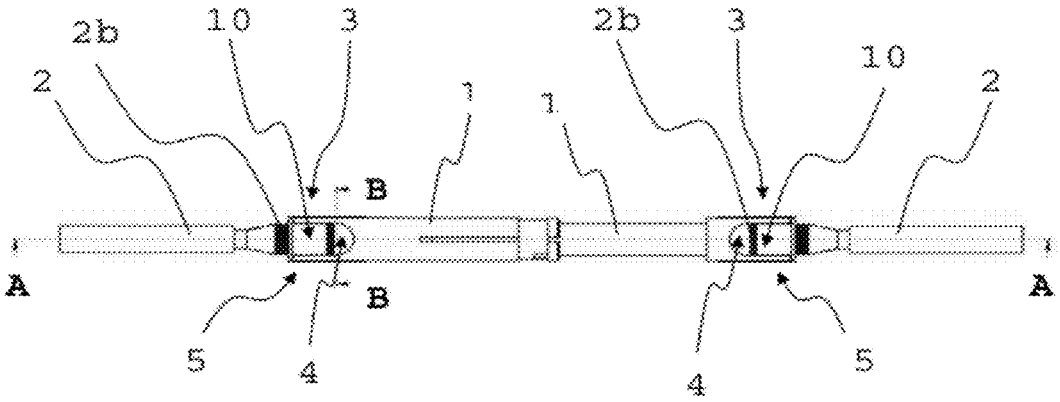
FIGS. 8A to 8C show a top view, a longitudinal section and a cross-section of a conductor with two contact elements connected thereto.
Figure 8B:
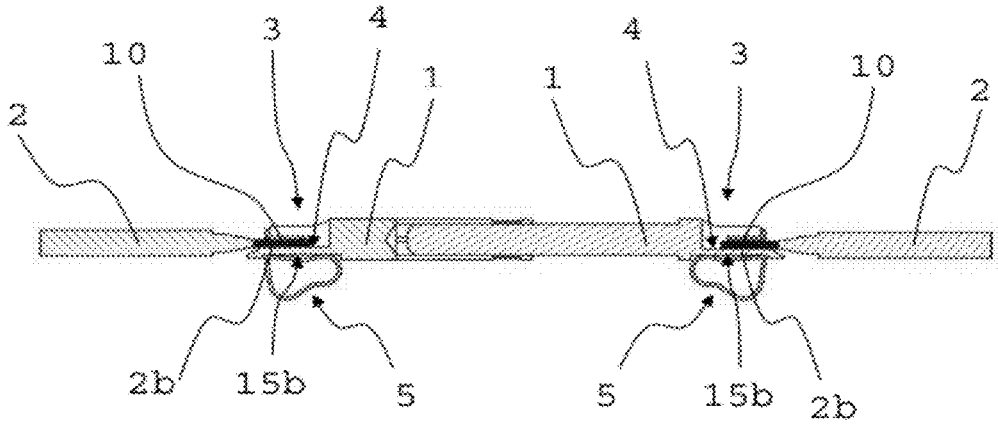

In an exemplary embodiment, FIG. 8A shows a top view of two screwless connection terminals each having one contact element 1 in the form of a contact pin and a socket contact which are mechanically plugged into each other and are electrically connected. Both contact elements 1 have in each case one connecting section 3 with a contact surface 4 which is electrically connected to a conductor 2 by means of the conductor cores 2*b* of the latter. FIG. 8B shows a longitudinal section of this arrangement and FIG. 8C shows a cross-section.

Figure 8C:
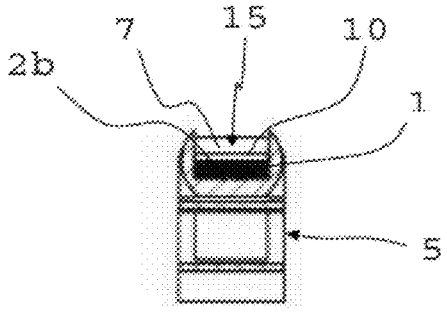

The conductor cores 2 of the conductor 2 are pressed down flatly onto the contact surfaces 4 of the contact elements 1 by the rectangular conductor clamp extension 10 (FIG. 8B), whereby the contact surface taken up by the conductor ends 2*b* rests on almost the entire usable electrical contact surface 4 within the guiding recess 15 (FIG. 8C).

Figure 9A:
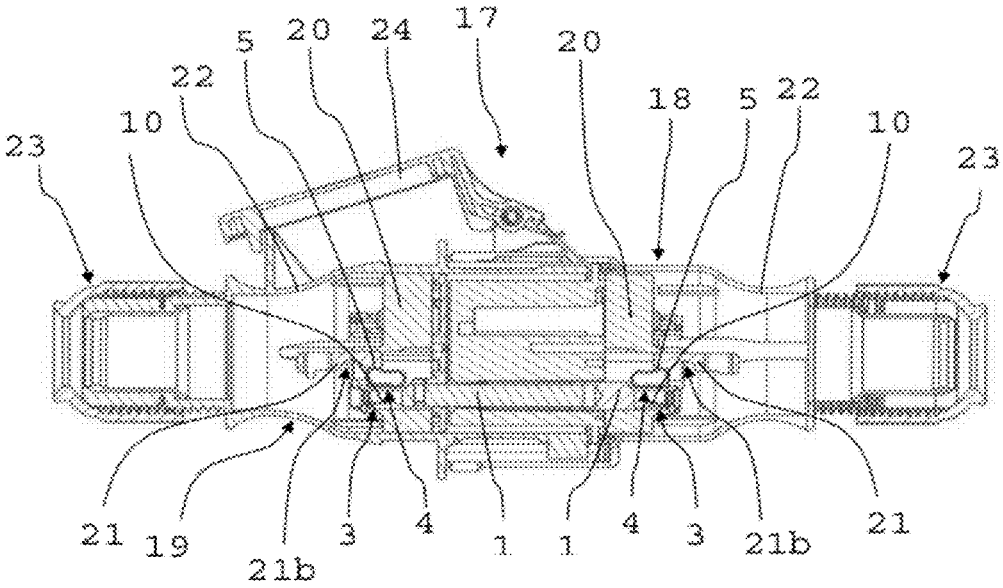
FIGS. 9A to 9B show a longitudinal section through a plug connector device with a plug connector and coupling housing with an opened clamp opening and a closed clamp opening of the clamp spring.
Figure 9B:
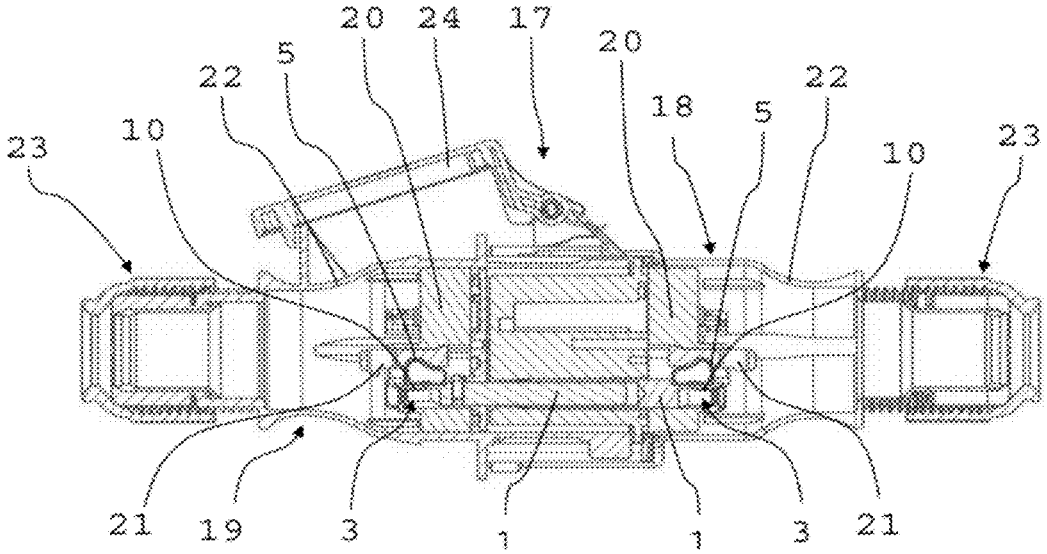

FIGS. 9A and 9B illustrate an exemplary embodiment of screwless connection terminals according to the invention, which are integrated in a plug connector arrangement 17 consisting of two mating plug connector devices, i.e. one plug connector and one coupling. Said plug connector arrangement 17 is prepared here for connecting on two sides to a conductor 2, wherein FIG. 9A shows plug connector devices with opened clamp openings 6 of the clamping legs 7 of the clamp spring 5, and FIG. 9B shows closed clamp openings 6.

As the one plug connector device, the plug connector arrangement 17 comprises a coupling device having a tubular coupling housing 18 and as the other plug connector device to be mated it comprises a plug connector device having a plug connector housing 19, wherein both devices are plugged into each other and are electrically connected to each other via the contact elements 1, i.e. socket contacts 1 and contact pins 1, which are in each case formed complementary and engage with each other. It is to be mentioned that in the views according to FIGS. 9A and 9B, for reasons of clarity, in each case only one contact element within one plug connector device is illustrated, wherein usually further contact pins or socket contacts are comprised in plug connector devices.

Both housings 18, 19 comprise in each case one cylindrical contact element carrier 20 which is formed to include individual receiving chambers for receiving further contact elements 1, consists of insulating material and is interlockable or otherwise connectable with the coupling housing 18 or the plug connector housing 19. The quantity of the respective receiving chambers for the pin-like or socket-like contact elements 1 in each cylindrical contact element carrier 20 depends on the intended use and can comprise, e.g., three receiving chambers (two phase contacts and one protective conductor contact), or four receiving chambers (three phase contacts and one protective conductor contact), or five receiving chambers (three phase contacts, one neutral conductor contact and one protective conductor contact). The two housings 18 and 19 comprise a protective part in the form of a hood 22 for introducing a conductor 2, and a rotatably actuatable strain relief device in the form of a clamping sleeve 23. Attached to the coupling housing 18 is a pivotable cover 24 which covers the socket contact 1 and protects it against splashing water when the coupling 18 is disengaged from the plug connector 19.

As shown in the FIGS. 9A and 9B, the contact surfaces 4 and the clamp springs 5 of the screwless connecting clamps extend in each case into individual receiving chambers of the contact element carrier 20. Said contact element carrier 20 is provided with access openings through which in each case one latch slide 21 as a contact opener extends.

Further access openings lead to the contact surfaces 4 of the contact elements 1. The latch slide 21 has a cut-out 21*b* in which the clamp spring 5 can engage. The latch slide 21 has the function of a pressing-down tool which can take up two positions, namely a release position of the clamp spring, as illustrated in FIG. 9B, and a pressing-down position of the clamp spring, as illustrated in FIG. 9A, in which the cut-out 21*b* in the latch slide 21 presses down the tensioning leg 9 of the clamp spring 5 and opens the clamp opening 6 so that the free conductor cores 2*b* can be slid into the clamp opening 6. The two mentioned positions of the latch slide 21 are determined by limit stops which abut against respective shoulders of the contact element carrier 20. In order to be able to easily displace the latch slide 21 between its two openings, an actuation opening is provided at which, for example, a screw driver can engage and move the latch slide back and forth.

Mounting the cable in the plug connector arrangement 17 in each case to the plug connector side and the couplings side is advantageously carried out as follows: first, a piece of the sheath of the cable or conductor 2 is removed to obtain individual insulated conductors 2. The front end of an individual conductor 2 is in each case stripped to obtain a bare conductor core 2*b*. The conductor 2 prepared in this manner is slid through the hood 22 into the interior of the plug connector housing 19 and analogously into the interior of the coupling housing 18 until the free core end 2*b*, in each case within reach of the clamp spring 5, reaches the contact element 1 in the contact element carrier 20.

As shown in FIG. 9A, the latch slide 21 is brought into the pressing-down position by compressing the clamp spring 5 so that the conductor core 2*b* can be slid into the clamp opening 6 thereby opened, wherein the conductor core 2*b* is then placed onto the contact surface 4 of the contact element 1. By displacing the latch slide 21 into the release position of the clamp spring 5, the latter pulls the caught core end 2*b* by means of the conductor clamp extension 10 and the clamping face 11 of the latter against the contact surface 4. Subsequently, the plug connector housing 19 and the coupling housing 18 are in each case connected to the contact element carrier 20 which takes place by axially plugging them together and by latching them, whereby the housing parts 18 and 19 are closed with the hood 22 in a water-tight manner.

In summary, it has become apparent that the invention thus provides a screwless connection terminal which is also suitable for the use in electric plug connector systems which are designed for three-phase current and/or alternating current and consist of a plug connector part and a coupling part or a wall socket such as, for example, connector plugs, flanged connector plugs, wall-mounted plugs, surface-mounted plugs and electrical outlets, the requirements for which are further described in the standards IEC 60309-1 and EN 60309-1, -2, even for the transmission of high currents, e.g. 32 A and higher.

This is made possible in that in contrast to conventional embodiments of clamp springs for screwless connection terminals according to the prior art, the clamping leg of the clamp spring has a conductor clamp extension 10 as an additional element, preferably in a shape comparable to a sheet metal extension or a sheet metal lug. Said conductor clamp extension has a defined clamping face and, through its function, significantly improves the function of the cross-section of the clamping leg in the clamp opening of conventional clamp springs, which clamping leg usually serves for clamping the conductor cores of the conductor to the contact surface of the contact element. In the clamping spring's state mounted to the contact element, said clamping face extends substantially parallel to the contact surface of the contact element and serves for pressing-down as well as for clamping the conductor cores of the conductor onto the contact surface of the contact element after the latter has been inserted into the clamp opening of the clamp spring.

In case of a conductor having a plurality of flexible conductor cores, e.g. in case of a stranded wire line, said conductor clamp extension provides for a flattening of the conductor core profile, wherein for this purpose, the clamp spring is adequately provided with a necessary spring preload force.

In addition to the described embodiments, the contact element can be equipped with at least one cooling surface element for improving the heat transfer to the environment, e.g. with a single-part or multi-part groove, e.g. a milled annular groove and/or a longitudinal groove, for increasing the surface of the contact element. Furthermore, the clamping face abutting on the conductor cores effects additional heat dissipation to the contact element via the clamp spring. For this, the abutting leg of the clamp spring can be form-fittingly connected to the contact element in a particularly advantageous manner via a recess in the contact element. Expediently, the recess has a profile shape that is complementary to the one of the abutting leg of the clamp spring.

To further improve the heat transfer, the electrical contact resistance and/or the heat exchange between two contact elements to be interconnected of plug connector devices to be mated, e.g. a plug connector with contact pins and a coupling with socket contacts, a socket-like contact element provided with a clamp spring ring 25 (e.g. FIGS. 6A to 6D) is proposed in a particularly advantageous embodiment. Such clamp spring rings serve for increasing the clamping connection force, i.e. when the pin-like contact elements, thus the contact pins, of a plug connector are plugged into the socket-like contact elements of a coupling. Preferably, this clamp spring ring is recessed within a groove or annular groove in the surface of the socket contact and is fixed with respect to axial displacement. Instead of a clamp spring ring, all other commercially available springs or spring elements suitable for increasing the clamping connection force of plug connector devices can also be used.

For a preferred development of the invention it was also described that the clamping face of the conductor clamp extension, at least in a partial area, has a clamping section that has a clamping face profile which, relative to the remaining clamping face of the conductor clamp extension, is curved or chamfered, wherein preferably the end section of the conductor clamp extension is formed in such a manner. Hereby, the electrical contact and the tensile strength of the connection terminal are further improved. However, it is also possible to provide the longitudinal profile of the conductor clamp extension in the axial direction of the conductor to be connected with a curvature, or to configure said profile in an angled manner.

An angled or chamfered profile, preferably in the connection direction of the conductor, the conductor clamp extension or a clamping section, allows that the latter presses transverse to the surface and at an angle into the surface of the conductor cores of the conductor even if the clamp opening of the clamp spring is closed after inserting the conductor, wherein the electrical contact resistance and the heat transfer resistance are further reduced. If an axial tensile force is exerted on the conductor or the cable, this has the effect that the end section of the conductor extension is further pressed into the conductor cores, whereby the deformation surface of the clamped conductor cores and the tensile resistance are further increased.

Also, the connecting section of the contact element, the contact surface thereof and/or the surface of the clamping face of the conductor clamp extension and of the angled or bent clamping section of the screwless connection terminal according to the invention can have an at least partially profiled contact surface. This surface profile can have a surface structure similar to a profile of pliers so that the conductor to be connected abuts with an improved frictional engagement, whereby, on the one hand, the electrical contact resistance and the heat transfer resistance is further reduced by pressing these surface structures into the conductor cores of the conductor and, on the other, a particularly effective mechanical connection with high tensile strengths between the core ends of the conductor and the contact element as well as the conductor clamp extension is achieved.

Optionally, a further reduction of the contact resistance and an improvement of the heat transfer as well as the corrosion resistance of the contact surface can be effected through a surface finish of these contact surfaces, e.g. by means of a metal alloy. In a particularly advantageous manner, said surface finish has a plastic or elastic deformability for increasing the contact surface and adapting the contact surface to the conductor profile when the conductor is clamped between the clamping face of the contact element and the conductor clamp extension of the clamp spring.

Furthermore, viewed in the axial direction of the conductor to be connected, the conductor clamp extension can have a particularly advantageously shaped cross-sectional profile in that said profile corresponds substantially to the cross-sectional profile of a conductor. Preferably, the cross-sectional profile of the conductor clamp extension can be semicircularly shaped or has a longitudinal notch or a comparable profile shape which encloses the conductor at least partially so that after inserting the conductor into the clamp opening of the clamp spring, the conductor cores of the conductor rest on the contact surface of the contact element and, upon closing the clamp opening, are laterally fixed by the conductor clamping element in that the clamping face of the conductor clamping element encloses the conductor cores.

For fixing the clamp spring to the contact element, the contact element can preferably have a guiding recess on its connecting section, wherein the conductor clamp extension of the clamp spring can engage axially in said guiding recess. In this guiding recess, the contact surface of the contact element is created, e.g. by milling, wherein the front face of the contact element is at least partially recessed so that the conductor can be inserted axially in the guiding recess and can be placed onto the contact surface. For laterally fixing the clamp spring and the conductor cores of the conductor with respect to rotating, the guiding recess has supporting legs on both axial sides of the contact element.

The clamp spring according to the invention used for connecting the conductor to a contact element is preferably made from am suitable electrically conductive strip material, usually from metal, using a punching and forming method. In order to obtain a clamp spring according to the invention which has the appropriate shape, an additional procedural step is used during the production process of the clamp spring, in which additional step preferably also a punching and forming method is used. The conductor clamp extension functioning as pressing-down and clamping element and/or the clamping section is directly formed from a segment of the clamping leg of the clamp spring in that said segment is bent in such a manner that the surface of said segment of the clamping leg is aligned substantially parallel to the surface of the abutting leg and/or, in the state mounted on the contact element, is aligned substantially parallel to the contact surface of the contact element. A conductor clamp extension produced in such a manner thus can be configured in a clamping plate-like manner.

In a further preferred method, the conductor clamp extension is produced as part of the punching process of the clamp opening in the clamping leg of the clamp spring necessary for passing through the conductor. Here, a segment of the clamping leg of the clamp spring is cut free by a partial separation, for example by a punching process, wherein one side of said segment remains integrally connected to the clamping leg. Subsequently, in a further bending process, this cut segment is bent out of the clamping leg and is suitably aligned or shaped in such a manner that the surface of said segment of the clamping leg is substantially parallel to the surface of the abutting leg of the clamp spring and/or, in the state mounted on the contact element, is aligned substantially parallel to the contact surface of the contact element. The window opening advantageously generated at the same time in the clamping leg of the clamp spring through this procedural step fulfils at the same time the function of a clamp opening for passing through a conductor when connecting to the screwless connection terminal. Thus, a conductor clamp extension produced in such a manner can also be formed in a clamping plate-like manner.

In an alternative method, the clamp opening in the clamping leg of the clamp spring is completely punched out. Subsequently, in a second procedural step, the conductor clamp extension is attached to the clamping leg, in particular by means a firmly bonding joining process, preferably by welding, joining, screwing or riveting or soldering. The material used for the conductor clamp extension can differ from the material of the clamp spring, wherein preferably, a metal or a material with a high electrical conductivity and a high thermal conductivity is used for producing the conductor clamp extension. The outer geometry and/or the cross-sectional profile of the conductor clamp extension can differ from the one of a clamp spring or the clamping leg thereof and all conceivable cross-sectional profiles and geometrical shapes suitable for the function of the conductor clamp extension are possible.

REFERENCE LIST

1 Contact element, contact pin, socket contact
2 Conductor
2*b* Conductor core
3 Connecting section
4 Contact surface

5 Clamp spring
6 Clamp opening
7 Clamping leg
8 Abutting leg
8*b* Segment of the abutting leg
9 Tensioning leg
10 Conductor clamp extension
10*b* Clamping section
11 Clamping face of the conductor clamp extension
11*b* Clamping face of the clamping section
12 Guide nose
13 Front face of the contact element
14 Supporting leg
15 Guiding recess
15*b* Recess
16 Chamfer of the guide nose
17 Electric plug connector arrangement
18 Coupling housing, coupling
19 Plug connector housing, plug connector
20 Contact element carrier
21 Latch slide, contact opener
21*b* Cut-out
22 Hood
23 Clamping sleeve
24 Pivotable cover
25 Clamp spring ring
E Insertion direction of a conductor

What is claimed is:

1. A screwless connection terminal comprising:

a contact element (1) to which a cable conductor (2) is to be electrically connected, the contact element comprising a connecting section (3) and a contact surface (4);

a clamp spring (5) having means for the cable conductor (2) to be clamped to the contact surface (4) of the contact element (1);

wherein the clamp spring (5) has a clamping leg (7), an abutting leg (8), and a tensioning leg (9), wherein a clamp opening (6) is formed in the clamping leg (7), the cable conductor (2) is to be led through the clamp opening, wherein the abutting leg (8) of the clamp spring (5) is abutting on the contact element (1), and the tensioning leg (9) of the clamp spring (5) extends from the abutting leg (8) to the clamping leg (7);

wherein the clamping leg (7) further comprises a conductor clamp extension (10) extending from the clamp opening (6) forming a clamping planar (11) which is substantially perpendicular to the clamping leg (7) and is aligned substantially parallel to the contact surface (4) of the contact element (1), wherein the cable conductor (2) is sandwiched between and touched by a surface section of the clamping planar (11) of the conductor clamp extension (10) and the contact surface (4) of the contact element (1); and a free end portion of the conductor clamp extension (10) has a clamping section (10*b*) with a clamping planar (11*b*) that is angled and curved relative to the clamping planar (11).

2. The screwless connection terminal according to claim 1, wherein the conductor clamp extension is integrally formed on the clamping leg (7).

3. The screwless connection terminal according to claim 1, wherein the conductor clamp extension (10) is angled substantially at an angle of 90 degrees relative to the clamping leg of the clamp spring (5).

4. The screwless connection terminal according to claim 1, wherein the conductor clamp extension (10) has a longitudinal profile that is angled and/or curved in the axial direction of the conductor (2) to be connected.

5. The screwless connection terminal according to claim 1, wherein the clamping planar (11, 11*b*) of the conductor clamp extension (10) and/or of the clamping section (10*b*) has a substantially rectangular shape.

6. The screwless connection terminal according to claim 1, wherein at least a portion of the clamping planar (11, 11*b*) of the conductor clamp extension (10) and/or of the clamping section (10*b*) has a chamfer.

7. The screwless connection terminal according to claim 1, wherein at least a portion of the clamping planar (11, 11*b*) of the conductor clamp extension (10) and/or of the clamping section (10*b*) and/or at least a portion of the contact surface (4) of the contact element (1) has a surface profile.

8. The screwless connection terminal according to claim 1, wherein along the axial direction of the conductor (2) to be connected, the conductor clamp extension (10) and/or the clamping section (10*b*) has a cross-sectional profile which corresponds substantially to at least a portion of the profile cross-section of the conductor (2).

9. The screwless connection terminal according to claim 1, wherein the conductor clamp extension (10) and/or the clamping section (10*b*) comprises the same material as the clamp spring (5).

10. The screwless connection terminal according to claim 1, wherein the clamp spring (5) and/or the conductor clamp extension (10) and/or the clamping section (10*b*) is configured as punching and forming part.

11. The screwless connection terminal according to claim 1, wherein the conductor clamp extension (10) and/or the clamping section (10*b*) is integrally connected to the clamping leg (7).

12. The screwless connection terminal according to claim 1, wherein at least a portion of the abutting leg (8) of the clamp spring (5) engages in the clamp opening (6) of the clamping leg (7).

13. The screwless connection terminal according to claim 1, wherein the cross-sectional profile of the clamp spring (5) has a substantially rectangular shape.

14. The screwless connection terminal according to claim 1, wherein at least a portion of the clamping leg (7) of the clamp spring (5) abuts on the front face of the contact element (13).

15. The screwless connection terminal according to claim 1, wherein the clamp spring (5) is fastened in a pre-tensioned state to the contact element (1).

16. An electrical conductor bus bar device for connecting one or a plurality of conductors, wherein said device comprises at last one screwless connection terminal according to claim 1.

17. The screwless connection terminal according to claim 1, wherein the clamp spring (5) is secured against displacement or rotation relative to the contact element (1) in that at least one section of the abutting leg (8) engages in a recess (15*b*) of the contact element (1), which recess is arranged on the side opposite to the guiding recess (15).

18. The screwless connection terminal according to claim 17, wherein the recess (15*b*) has a plane surface which is connected to the abutting leg (8) of the clamp spring (5).

19. The screwless connection terminal according to claim 1, wherein the contact element (1) has at least one cooling surface element.

20. The screwless connection terminal according to claim 19, wherein the cooling surface element is configured as a single-part or a multi-part annular groove and/or longitudinal groove on the contact element (1).

21. An electrical plug connector device, wherein the same comprises at least one screwless connection terminal according to claim 1.

22. The electrical plug connector device according to claim 21, wherein the same is configured as an electrical plug connector having a plug connector housing (19) and/or as an electrical coupling having a coupling housing (18) and/or as an electrical socket and has a contact element carrier (20) to which the screwless connection terminal is attached.

23. The screwless connection terminal according to claim 1, wherein the contact element (1) has a guiding recess (15) which is provided with a contact surface (4).

24. The screwless connection terminal according to claim 23, wherein the conductor clamp extension (10) and/or the clamping section (10*b*) engages in the guiding recess (15) of the contact element (1).

25. The screwless connection terminal according to claim 24, wherein the guiding recess (15) has at least one lateral supporting leg (14) for laterally fixing the conductor clamp extension (10) and/or the clamping section (10*b*).

26. A method for producing a screwless connection terminal according to claim 1, wherein the conductor clamp extension (10) and/or the clamping section (10*b*) is formed from a segment of the clamping leg (7) of the clamp spring (5).

27. The method for producing a screwless connection terminal according to claim 26, wherein the conductor clamp extension (10) and/or the clamping section (10*b*) and/or the clamp opening (6) is formed by partially separating the segment from the clamping leg (7) of the clamp spring (5) and the surface of this segment of the clamping leg (7) is aligned substantially parallel to the surface of the abutting leg (8) of the clamp spring (5) and/or substantially parallel to the contact surface (4) of the contact element (1) by a subsequent bending process.

28. The method for producing a screwless connection terminal according to claim 27, wherein the segment is separated from the clamping leg (7) of the clamp spring (5) by means of a punching process.

29. The screwless connection terminal according to claim 1, wherein the contact element (1) has a guide nose (12) which is inserted through the clamp opening (6) in the clamping leg (7).

30. The screwless connection terminal according to claim 29, wherein the guide nose (12) has a surface which is an extension of the contact surface (4).

31. The screwless connection terminal according to claim 29, wherein at least one section of the guide nose (12) has a chamfer (16).

* * * * *